US009945089B2

(12) United States Patent
Van Vessem

(10) Patent No.: US 9,945,089 B2
(45) Date of Patent: Apr. 17, 2018

(54) TEMPLATE FOR AND METHOD OF INSTALLING A PLURALITY OF FOUNDATION ELEMENTS IN AN UNDERWATER GROUND FORMATION

(71) Applicant: IHC HOLLAND IE B.V., Sliedrecht (NL)

(72) Inventor: Henricus Gerardus Andreas Van Vessem, Vught (NL)

(73) Assignee: IHC HOLLAND IE B.V., Sliedrecht (NL)

( * ) Notice: Subject to any disclaimer, the term of this patent is extended or adjusted under 35 U.S.C. 154(b) by 0 days.

(21) Appl. No.: 14/377,599

(22) PCT Filed: Feb. 8, 2013

(86) PCT No.: PCT/NL2013/050076
§ 371 (c)(1),
(2) Date: Aug. 8, 2014

(87) PCT Pub. No.: WO2013/122457
PCT Pub. Date: Aug. 22, 2013

(65) Prior Publication Data

US 2015/0023738 A1 Jan. 22, 2015

(30) Foreign Application Priority Data

Feb. 13, 2012 (NL) ..... 2008279

(51) Int. Cl.
*E02D 27/12* (2006.01)
*E02D 27/52* (2006.01)
(Continued)

(52) U.S. Cl.
CPC ..... *E02D 13/04* (2013.01); *E02D 27/52* (2013.01); *E02D 27/525* (2013.01)

(58) Field of Classification Search
CPC ..... E02D 27/12; E02D 27/52; E02D 27/50; E02D 13/04; E02D 27/525; E02D 27/32; E02D 11/00
(Continued)

(56) References Cited

U.S. PATENT DOCUMENTS 3,094,847 A * 6/1963 Pogonowski ..... E21B 17/00 182/130
3,134,235 A * 5/1964 Parker ..... E21B 17/0004 405/228
(Continued)

FOREIGN PATENT DOCUMENTS

EP 2402511 1/2012
GB 2436320 A 9/2007
(Continued)

OTHER PUBLICATIONS

International Search Report and Written Opinion dated Apr. 2, 2013 for corresponding International Application No. PCT/NL2013/050076, filed Feb. 8, 2013.
(Continued)

*Primary Examiner* — Benjamin F Fiorello
*Assistant Examiner* — Edwin J Toledo-Duran
(74) *Attorney, Agent, or Firm* — Steven M. Koehler; Westman, Champlin & Koehler, P.A.

(57) ABSTRACT

A template for use in installing a plurality of foundation elements, in particular anchor piles, relative to one another in an underwater ground formation, comprises at least a guide for guiding a foundation element in a guiding direction during driving the foundation element into a seabed, and a frame including a holding member for holding the guide in transverse direction of the guiding direction. The template further comprises a levelling mechanism for levelling the frame with respect to a seabed when it is placed thereon. The
(Continued)

guide is freely displaceable with respect to the holding member in the guiding direction.

18 Claims, 4 Drawing Sheets

(51) Int. Cl.
*E02D 27/50* (2006.01)
*E02D 27/32* (2006.01)
*E02D 13/04* (2006.01)

(58) Field of Classification Search
USPC ..... 405/228, 229, 231, 232, 233, 224, 195.1
See application file for complete search history.

(56) References Cited

U.S. PATENT DOCUMENTS 3,846,991 A * 11/1974 Wisotsky ..... E21B 17/02 173/1
3,927,722 A * 12/1975 Frederick ..... E02D 7/00 173/125
4,033,139 A * 7/1977 Frederick ..... E02B 17/027 173/DIG. 1
4,069,683 A * 1/1978 Jansz ..... E02B 17/027 405/227
4,102,147 A 7/1978 Jansz
4,110,993 A * 9/1978 Heerema ..... 405/228
4,117,690 A * 10/1978 Besse ..... E02B 17/027 405/208
4,154,307 A * 5/1979 Gendron ..... E02D 7/02 173/21
4,202,421 A * 5/1980 Pinck ..... E21B 10/40 175/374
4,238,166 A * 12/1980 Gendron ..... E02D 7/02 173/DIG. 1
4,679,964 A * 7/1987 Blandford ..... E02B 17/027 166/356
4,727,943 A * 3/1988 Wood ..... E21B 10/18 175/229
4,812,080 A * 3/1989 Urquhart ..... E02B 17/027 405/204
4,818,149 A * 4/1989 Kuehn ..... E02D 7/02 173/1
4,856,938 A * 8/1989 Kuehn ..... E02D 9/04 166/55
4,872,514 A * 10/1989 Kuehn ..... E02D 7/02 173/132
4,904,119 A * 2/1990 Legendre ..... E02D 17/13 405/228
4,966,498 A * 10/1990 Blum ..... E02D 5/38 175/171
5,421,676 A * 6/1995 Wybro ..... B63B 9/065 405/204
5,667,341 A * 9/1997 Kuehn ..... B63C 11/52 294/66.2
5,788,418 A * 8/1998 Kuehn ..... E02D 7/10 405/228
5,915,883 A * 6/1999 Kuehn ..... E21B 7/124 405/191
2008/0292407 A1* 11/2008 Jonker ..... E02D 7/10 405/228
2010/0166503 A1* 7/2010 Will ..... E02D 27/42 405/224
2011/0318113 A1* 12/2011 Fraenkel ..... E02B 17/02 405/224
2012/0014753 A1* 1/2012 Jung ..... E02D 13/00 405/227
2012/0177447 A1 7/2012 Fraenkel et al.

FOREIGN PATENT DOCUMENTS

GB 2467842 A 8/2010
GB 2469190 A 10/2010
JP H11-29943 A 2/1999
JP 2012-12930 A 1/2012
NL 7512022 A 4/1977

OTHER PUBLICATIONS

English translation of Notice of Reasons for Rejection for Japanese patent application No. 2014-556503, dated Jul. 25, 2016.

* cited by examiner

TEMPLATE FOR AND METHOD OF INSTALLING A PLURALITY OF FOUNDATION ELEMENTS IN AN UNDERWATER GROUND FORMATION

CROSS-REFERENCE TO RELATED APPLICATION

This application is a Section 371 National Stage Application of International Application PCT/NL2013/050076 filed Feb. 8, 2013 and published as WO2013/122457 A1 in English.

BACKGROUND

The discussion below is merely provided for general background information and is not intended to be used as an aid in determining the scope of the claimed subject matter.

The present invention relates to a template for use in installing a plurality of foundation elements, in particular anchor piles, relative to one another in an underwater ground formation, comprising at least a guide for guiding a foundation element in a guiding direction during driving of the foundation element into a seabed, and a frame including a holding member for holding said guide in transverse direction of the guiding direction.

Such a template is known from the European patent application EP 2 402 511 of the same applicant. The known template is suitable to install anchor piles in a predetermined formation with the template remaining stationary on the seabed. The template can be re-used for installing further foundation elements on other sites since after installing the anchor piles the template is lifted over the ends of the installed piles that project upwardly from the seabed and moved to the next installation site. The installed anchor piles may receive a jacket as a base for a wind turbine, for example a tripod jacket.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the Background A template according to an aspect of the invention comprises a levelling mechanism for levelling the frame with respect to a seabed when it is placed thereon, and wherein the guide is freely displaceable with respect to the holding member in the guiding direction.

Due to this feature, the template provides the opportunity to position the guides vertically without loosing contact with the seabed. Since the guide is freely displaceable with respect to the holding member, the frame may force the guide to a desired vertical position upon levelling the frame on an inclined seabed, for example. In such a case it is not necessary to apply additional power tools to move the guide with respect to the holding member.

The guide may be provided with a suspended element, wherein the guide and the holding member are adapted such that upon lifting the frame the holding member displaces upwardly with respect to the guide until the holding member contacts the suspended element of the guide so as to lift the guide, as well. In this embodiment the suspended element may have the function of a temporarily locking means, for example in case of transporting the template from a vessel to the seabed, since the guide may suspend from the holding member by means of the suspended element upon supporting the frame. Instead of or in addition to the suspended element the template may comprise an alternative locking device for locking the guide with respect to the holding member in a predetermined mutual position. In a practical embodiment the suspended element comprises an arresting ring and the holding member has a cylindrical upper end surrounding the guide, wherein the arresting ring has a larger diameter than the upper end of the holding member.

The guide may comprise a sleeve for surrounding a foundation element during driving. Preferably, the guide comprises a sound insulating sleeve, because this reduces underwater noise input during driving a foundation element into the seabed.

The levelling mechanism may comprise at least an inflatable bag mounted at a bottom portion of the frame. The bag may be inflated by means of a fluid, i.e. a liquid or a gas. Under off-shore conditions inflating by using sea water may be preferred. The bag is preferably provided with an outer shield for protecting the bag. The levelling mechanism may be located at a distance from the holding member and the guide.

In a practical embodiment the holding member comprises two aligned rings located at a distance from each other, which rings surround the guide. In this case the center lines of the rings substantially coincide. The guide may extend above the holding member, but in general the smallest portion of its length will extend above the holding member, for example less than 25% of its length.

In an alternative embodiment the frame comprises at least two first rings at angular distance around a central axis of the frame and a rotation device for rotating a second ring between the angular positions of the first rings such that a temporary holding member for holding a sleeve-shaped guide can be formed at each of the respective angular positions. This means that a first temporary holding member including one of the first rings and the second ring, and a second temporary holding member including the other one of the first rings and the second ring can be formed. In this embodiment it is possible that the guide is removed from the first temporary holding member after guiding the foundation element during driving this into the seabed before forming the second holding member.

The invention is also related to a method of installing a plurality of foundation elements by means of a template as described hereinbefore, wherein the frame including the guide is placed on a seabed, after which the frame is leveled by means of the levelling mechanism. The levelling action will move the frame with respect to the seabed to a position in which the holding member holds the guide in a vertical position. Since the guide is freely displaceable with respect to the holding member the guide can automatically arrive in the desired vertical position during the levelling action.

After installing the foundation elements by inserting the foundation elements into the corresponding guides and driving them into the seabed, the template including the guide may be lifted over the ends of the installed foundation elements extending above the ground formation, and moved to another site for installing a plurality of foundation elements.

BRIEF DESCRIPTION OF THE DRAWINGS

Aspects of the invention will hereafter be elucidated with reference to drawings showing an embodiment of the invention very schematically.

DETAILED DESCRIPTION OF THE ILLUSTRATIVE EMBODIMENTS

Figure 1:
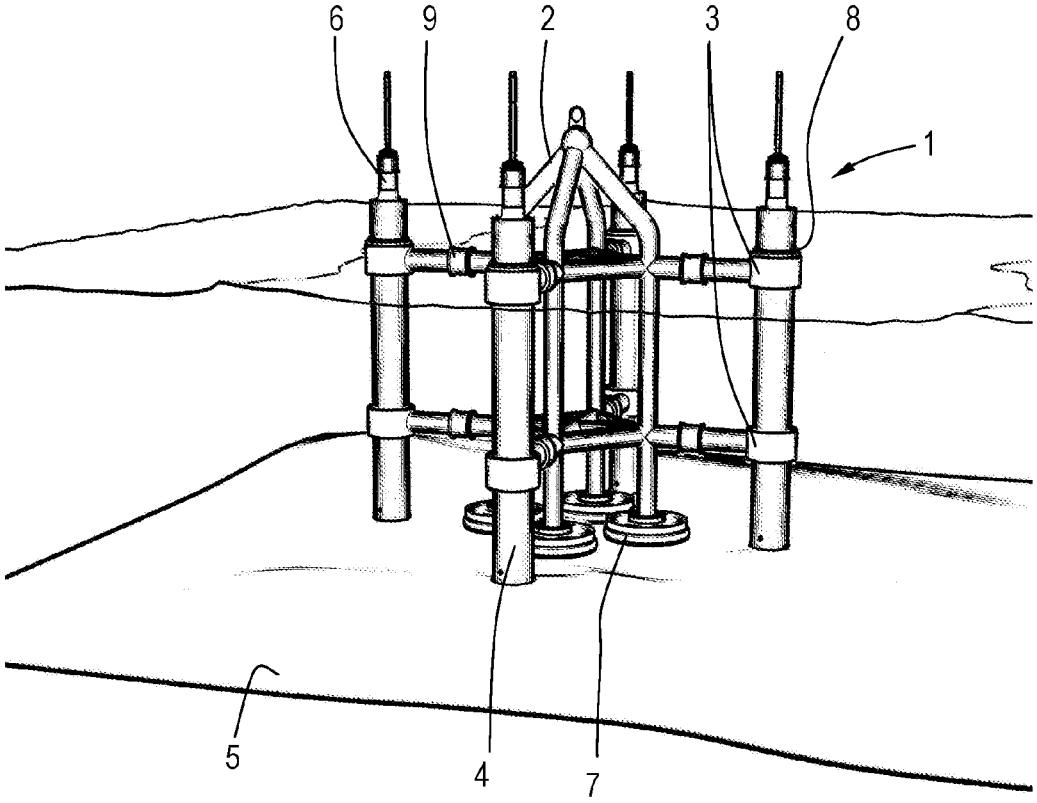
FIG. 1 is a perspective view of an embodiment of a template.
Figure 2:
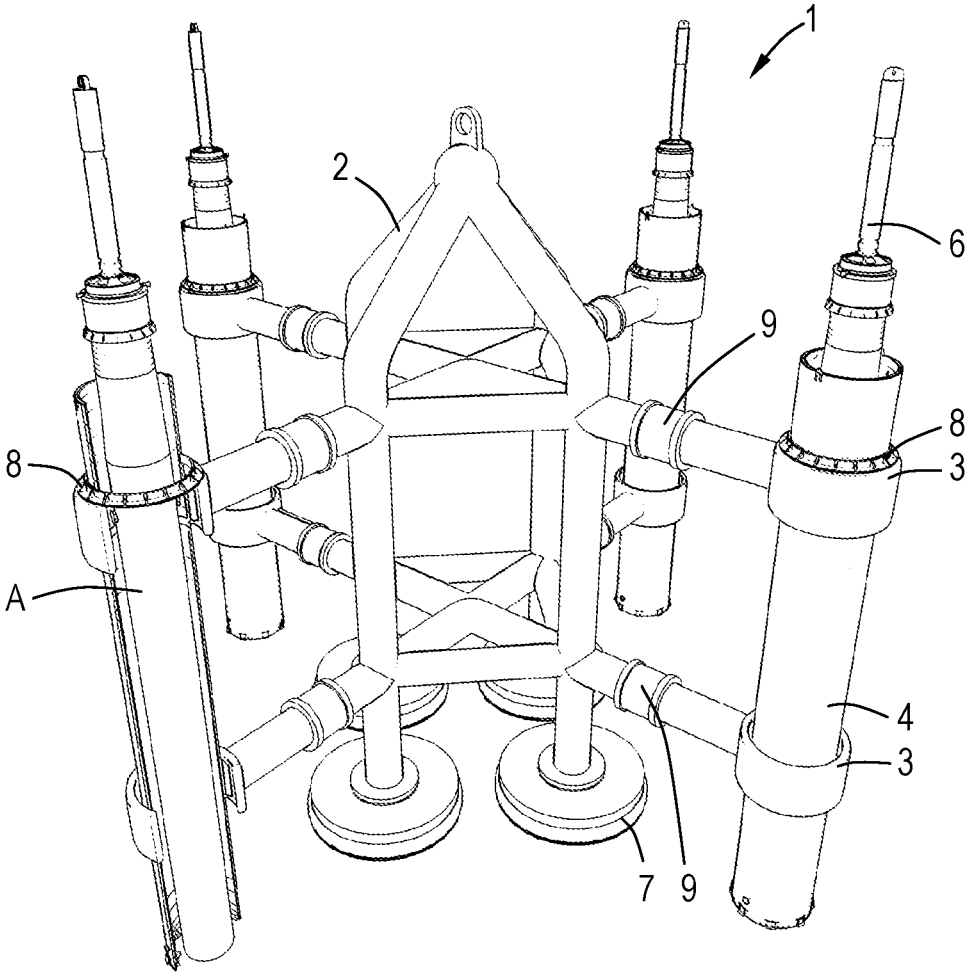
FIG. 2 is a similar view as FIG. 1 as seen from above, partially in a cut-away view.

FIGS. 1 and 2 show an embodiment of a template 1. The template 1 comprises a frame 2 which has four holding members 3 for holding respective guides 4. Each of the holding members 3 comprises a lower ring and an upper ring for holding the guide 4. The guide 4 serves to guide a foundation element such as an anchor pile A during driving, see FIG. 2. In the embodiment as shown in FIGS. 1 and 2 the template 1 comprises four guides 4 which are formed by hollow cylinders or sleeves that surround the anchor pile A during driving. Each of the guides 4 has a guiding direction which extends along the center line of the cylinder. In practice the guiding direction is substantially vertical since it is mostly desired to install anchor piles A vertically.

The holding members 3 of the template 1 are fixed relative to each other by means of the frame 2 such that a plurality of anchor piles A can be driven into a seabed 5 in a predetermined pattern. The center lines of the guides 4 of the embodiment as shown correspond to a square as seen from above, but different shapes and dimensions are conceivable, dependent on the structure of a jacket that must be placed onto the installed anchor piles A afterwards.

After installing the template 1 from a surface vessel (not shown) onto the seabed 5, the anchor piles A are transported to the template and inserted into the guides 4. Each of the anchor piles A is driven into the seabed 5 by means of a hydraulic driver 6, for example an IHC Hydrohammer, which is connected to a power pack on board of the surface vessel. FIG. 1 shows four drivers 6, but it is conceivable to use less drivers 6 such that one driver 6 drives more than one anchor pile A into the seabed 5. In the embodiment as shown in FIGS. 1 and 2 each of the guides 4 is provided with a sound-insulating sleeve that surrounds the anchor pile A during driving. This reduces noise input from the driver 6 into the surrounding water. Such a sound-insulating sleeve may be of the type as described in EP 2 402 511. It is noted that in case of noise reduction sleeves the length of the guides 4 have at least the same length as the anchor piles A, which may be 30-50 m, for example.

FIG. 1 illustrates a situation in which the guides 4 project above the water surface when the template 1 rests on the seabed 5, but in an alternative embodiment the lengths of each of the guides 4 may be such that they stay below sea level.

Furthermore, the template 1 is provided with a levelling mechanism for levelling the frame 2 with respect to the seabed 5 in order to be able to create vertical positions of the guides 4. The levelling mechanism in the embodiment as shown in FIGS. 1 and 2 comprises four inflatable bags 7. The bags 7 are disposed at a mutual distance and mounted to a bottom portion of the frame 2. The bags 7 can be inflated independently from each other so as to level the frame 2 with respect to the seabed 5, for example when the seabed is inclined at the location where the template 1 is placed.

The guides 4 are freely displaceable with respect to their corresponding holding members 3 in the guiding direction. In the embodiment as shown in FIGS. 1 and 2 the guides 4 can slide within their corresponding rings of the respective holding members 3. When placing the template 1 onto the seabed 5 the guides 4 may also rest on the seabed 5. If the frame 2 is leveled by means of the bags 7 the holding members 3 will be leveled accordingly. Since the guides 4 are freely displaceable with respect to the respective holding members 3 the guides 4 can be automatically positioned vertically whereas the guides 4 remain on the seabed 5. This may be desired for minimizing sound emission during driving of the anchor piles A into the seabed 5.

FIGS. 1 and 2 show that each of the guides 4 is provided with a suspended element, in this case an arresting ring 8. The arresting ring 8 is attached to the guide 4 and has a larger outer diameter than the inner diameter of the upper ring of the corresponding holding member 3. As a consequence, upon lifting the frame 2, for example from the seabed 5 after the anchor piles A have been driven into the seabed 5, the holding members 3 are displaced upwardly with respect to the guides 4 until the upper rings of the holding members 3 support the respective guides 4 at the arresting rings 8. On the other hand, upon placing the frame 2 including the guides 4 onto the seabed 5 at a different site the guides 4 will contact the seabed 5 prior to the frame 2 contacts the seabed such that the holding members 3 are subsequently displaced downwardly with respect to the respective guides 4 until the frame 2 also contacts the seabed 5. During the latter action the contact between the arresting rings 8 and the corresponding holding members 3 will be lost. This condition can be achieved in case the length of the guide 4 below the arresting ring 8 is larger than the distance between an upper contact surface of the upper ring of the holding member 3 with the arresting ring 8 and the bottom of the frame 2 which contacts the seabed 5.

In a next step, the frame 2 can be leveled by means of inflating the bags 7 such that the arresting rings 8 may remain free from contact with the corresponding holding members 3. Hence, during levelling the guides 4 are freely displaceable with respect to the corresponding holding members 3. In this case the arresting rings 8 are used to transport the guides 4 together with the frame 2. In fact they form a locking device for locking the guide 4 with respect to the holding member temporarily.

Alternatively, the length of the guide 4 below the arresting ring 8 may be shorter than the distance between an upper contact surface of the upper ring of the holding member 3 with the arresting ring 8 and the bottom of the bags 7 in at least an inflated condition thereof. This means that in the inflated condition the guides 4 may be free from the seabed 5 such that upon levelling the frame 2 the guides 4 will automatically obtain a vertical position when they suspend from the respective upper rings of the holding members 3. If the guides 4 loose their contact with the seabed 5 upon inflating the bags 7 a horizontal force on the guides 4 by the seabed 5 will be eliminated in case of levelling the frame 2 at an inclined seabed 5.

The embodiment of the template 1 as shown in FIGS. 1 and 2 comprises four holding members 3 at equi-angular positions around a central axis of the frame 2, but a different number of holding members 3 is conceivable.

Furthermore, the template 1 is provided with coupling members 9 for coupling the rings of the holding members 3 to the rest of the frame 2. The coupling members 9 may be provided with easy fittings in order to be able to replace the rings quickly, for example by rings of a different size, or to introduce an additional rod between the rings and the rest of the frame 2 so as to increase the distances between the central axis of the frame 2 and the holding members 3. It is also possible that the coupling members 9 comprise a spring and/or damping function in order to reduce transfer of vibrations from the drivers 6 to the frame 2.

Figure 3:
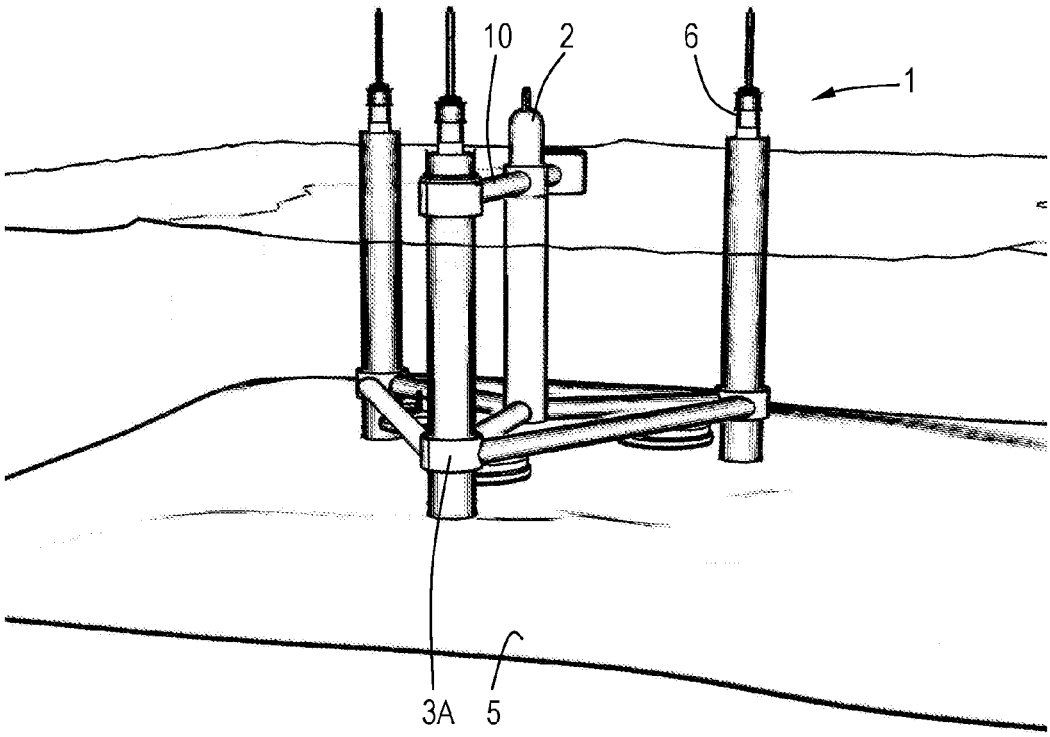
FIG. 3 is a similar view as FIG. 1, but showing an alternative embodiment of a template.
Figure 4:
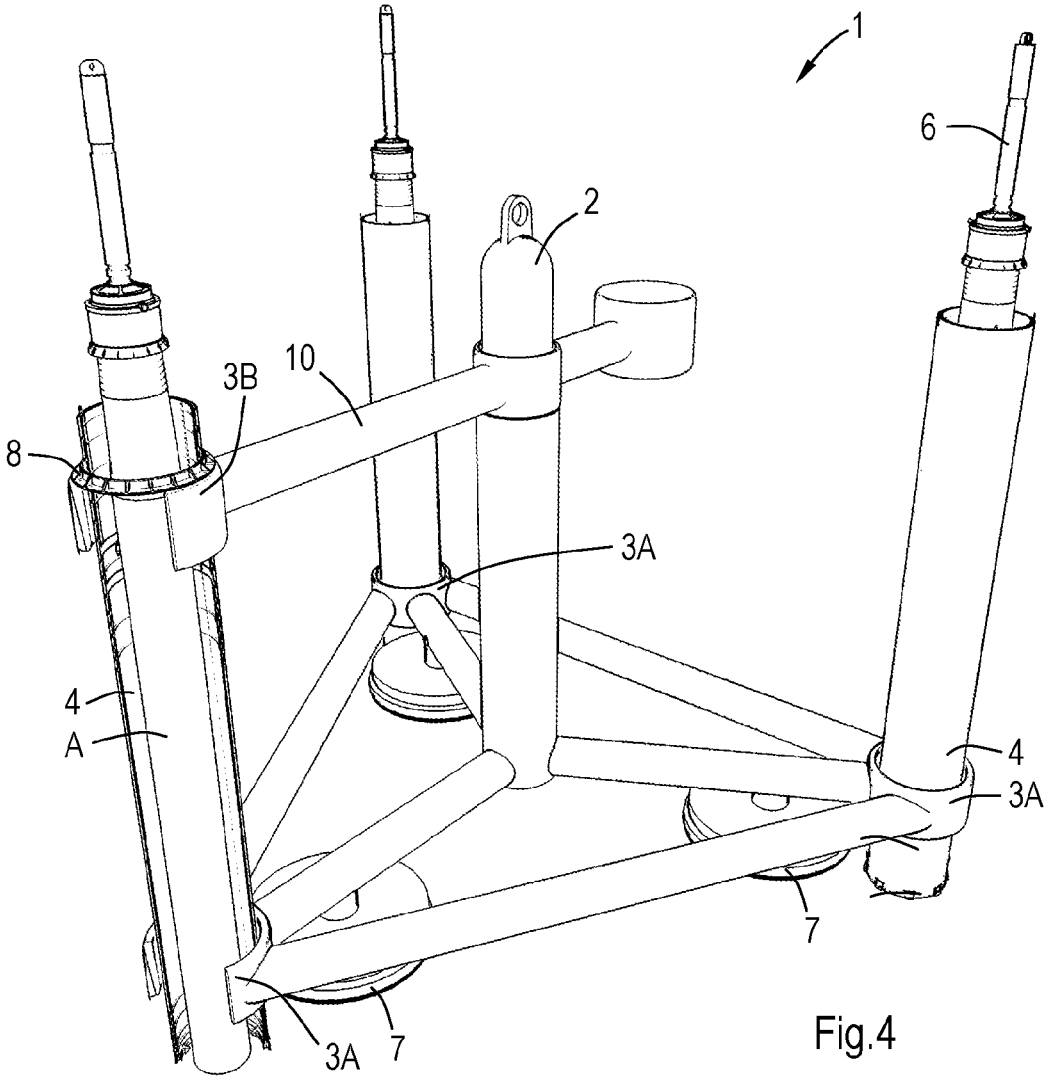
FIG. 4 is a similar view as FIG. 3 as seen from above, partially in a cut-away view.

FIGS. 3 and 4 show an alternative embodiment of the template 1 according to the invention. In these figures identical reference signs as used in FIGS. 1 and 2 are now used for corresponding parts. In the embodiment of FIGS. 3 and 4 the frame 2 comprises three first rings 3A, which are located at equi-angular distance around the central axis of the frame 2. The frame 2 is further provided with a rotation device 10, in this case a horizontal bar which is rotatable about the central axis of the frame 2. At the end of the bar a second ring 3B is mounted. The rotation device 10 can rotate the second ring 3B between the angular positions of the first rings 3A. In this case the second ring 3B is substantially the same as the first ring 3A, but may be different in an alternative embodiment.

FIG. 4 shows a condition in which the second ring 3B is turned above the first ring 3A at the left side of the template 1 such that both rings 3A, 3B are aligned in upward direction and have coinciding central axes. Thus, at that side of the template 1 a temporary holding member 3A, 3B is formed for holding the guide 4. In this condition an anchor pile A can be inserted in the temporary holding member 3A, 3B. After driving the anchor pile A into the sea bed, and possibly removing the guide 4 from the temporary holding member 3A, 3B, the rotating device 10 can be rotated such that the second ring 3B is located above and aligned with another first ring 3A so as to form a next temporary holding member 3A, 3B, in which the guide 4 can be placed.

In fact, the template 1 as shown in FIGS. 3 and 4 only needs one driver 6 and one guide 4. After installing the anchor piles A, the template 1 is lifted over the ends of the installed foundation elements extending above the ground formation, and moved to another site where other anchor piles A can be installed.

The template 1 as shown in FIGS. 3 and 4 can form three temporary holding members 3A, 3B, but templates for creating more or less temporary holding members are possible.

From the foregoing it will be clear that the template according to the invention provides a simple template which can be easily leveled on a non-flat seabed.

The invention is not limited to the embodiment shown in the drawings and described hereinbefore, which may be varied in different manners within the scope of the claims. For example, it is possible that the holding member comprises a single cylindrical element instead of two aligned rings. The levelling device may comprise alternative lifting means such as hydraulic cylinders or the like.

What is claimed is:

1. A template for use in installing a plurality of foundation elements relative to one another in an underwater ground formation, comprising:

at least a guide configured to guide a foundation element in a guiding direction during driving the foundation element into a seabed;

a frame including a holding member configured to hold said guide in a transverse direction of the guiding direction, wherein the guide is freely displaceable with respect to the holding member such that the guide is movable in the guiding direction by a force of the frame upon levelling the frame;

a levelling mechanism configured to level the frame with respect to the seabed when the frame is placed thereon; and wherein the template is free from power tools to move the holding member with respect to the guide.

2. The template according to claim 1, wherein the guide is provided with a suspended element, and wherein the guide and the holding member are configured such that upon lifting the frame the holding member displaces upwardly with respect to the guide until the holding member contacts the suspended element of the guide so as to lift the guide.

3. The template according to claim 1, wherein the guide comprises a sleeve configured to surround a foundation element of the plurality of foundation elements during driving.

4. The template according to claim 2, wherein the suspended element comprises an arresting ring and the holding member has a cylindrical upper end surrounding the guide, wherein the arresting ring has a larger diameter than the cylindrical upper end of the holding member.

5. The template according to claim 1, wherein the guide comprises a sound insulating sleeve.

6. The template according to claim 1, wherein the levelling mechanism comprises at least an inflatable bag mounted at a bottom portion of the frame.

7. The template according to claim 6, wherein the inflatable bag is provided with an outer shield for protecting the inflatable bag.

8. The template according to claim 1, wherein the template comprises a locking device configured to lock the guide with respect to the holding member.

9. The template according to claim 1, wherein the holding member comprises two aligned rings located at a distance from each other, which rings surround the guide.

10. The template according to claim 1, wherein the template comprises three or four holding members including corresponding guides at equi-angular positions around a central axis of the frame.

11. The template according to claim 1, wherein the frame comprises at least two first rings at angular distance around a central axis of the frame and a rotation device configured to rotate a second ring between angular positions of the first rings such that a temporary holding member configured to hold a sleeve-shaped guide is formed at each of said respective angular positions.

12. A method of installing a plurality of foundation elements relative to one another in an underwater ground formation with a template including at least a guide configured to guide a foundation element in a guiding direction during driving the foundation element into a seabed, and a frame including a holding member configured to hold said guide in transverse direction of the guiding direction, the method comprising:

placing the frame including the guide on a seabed; and levelling the frame, wherein levelling further comprises allowing free automatic vertical adjustment between the guide and the holding member with the guide in direct contact with the seabed, without using power tool to move the holding member with respect to the guide.

13. The method according to claim 12, and further comprising, after installing the foundation elements, lifting the template including the guide over ends of the installed foundation elements extending above the underwater ground formation; and moving the template including the guide to another site for installing a plurality of foundation elements.

14. The method according to claim 13, wherein the guide further comprises a suspended element, the method further comprising, upon moving the template, displacing the holding member upwardly with respect to the guide until the holding member contacts the suspended element of the guide so as to lift the guide.

15. The method according to claim 12, wherein levelling further comprises positioning the guides vertically without losing contact with a seabed.

16. The method according to claim 12, wherein levelling moves the frame with respect to the seabed to a position in which the holding member holds the guide in a vertical position.

17. The method according to claim 12, wherein allowing free adjustment between the guide and the holding member moves the guide to a desired vertical position during the levelling.

18. A template for use in installing a plurality of foundation elements relative to one another in an underwater ground formation, comprising:

at least a guide configured to guide a foundation element in a guiding direction during driving the foundation element into a seabed;

a frame including a holding member configured to hold said guide in a transverse direction of the guiding direction; and a levelling mechanism configured to level the frame with respect to the seabed when the frame is placed thereon, the guide configured to be freely displaceable with respect to the holding member in the guiding direction and automatically positioned vertically in direct contact with the seabed when the frame contacts the seabed; and wherein the template is free from power tools suitable to move the holding member with respect to the guide.

* * * * *